US009169571B2

(12) United States Patent
Stapley et al.

(10) Patent No.: US 9,169,571 B2
(45) Date of Patent: Oct. 27, 2015

(54) METHODS FOR THE ELECTROLYTIC PRODUCTION OF XYLO-PENT-1,5-DIOSE

(75) Inventors: Jonathan A. Stapley, Bellevue, WA (US); J. David Genders, Elma, NY (US); Daniel M. Atherton, Lancaster, NY (US); Peter M. Kendall, East Amherst, NY (US)

(73) Assignee: Dynamic Food Ingredients Corporation, Kirkland, WA (US)

( * ) Notice: Subject to any disclaimer, the term of this patent is extended or adjusted under 35 U.S.C. 154(b) by 1086 days.

(21) Appl. No.: 13/058,121

(22) PCT Filed: Jul. 28, 2009

(86) PCT No.: PCT/US2009/051897

§ 371 (c)(1),
(2), (4) Date: Mar. 30, 2011

(87) PCT Pub. No.: WO2010/017059

PCT Pub. Date: Feb. 11, 2010

(65) Prior Publication Data

US 2011/0180418 A1 Jul. 28, 2011

Related U.S. Application Data

(60) Provisional application No. 61/087,350, filed on Aug. 8, 2008.

(51) Int. Cl.
*C25B 3/02* (2006.01)

(52) U.S. Cl.
CPC ..... *C25B 3/02* (2013.01)

(58) Field of Classification Search
CPC ..... C25B 3/02
USPC ..... 205/421, 448, 449
See application file for complete search history.

(56) References Cited

U.S. PATENT DOCUMENTS

| | | | |
|---|---|---|---|
| 2,989,569 | A | 6/1961 | Apel |
| 3,558,725 | A | 1/1971 | Kohno et al. |
| 4,008,285 | A | 2/1977 | Melaja et al. |
| 4,950,366 | A | 8/1990 | Jiricny et al. |

(Continued)

FOREIGN PATENT DOCUMENTS

CN 101009161 A * 8/2007 ..... H01G 9/042

OTHER PUBLICATIONS

Chen et al., "Pulsed Electrodeposition of Pt Nanoclusters on Carbon Nanotubes Modified with Carbon Materials Using Diffusion Restricting Viscous Electrolytes", Electrochemistry Communications (no month, 2007), vol. 9, pp. 1348-1354.*

(Continued)

*Primary Examiner* — Edna Wong
(74) *Attorney, Agent, or Firm* — Brinks Gilson & Lione; Ryan L. Marshall

(57) ABSTRACT

Method and electrochemical cells for producing xylo-pent-1,5-diose are provided. The xylo-pent-1,5-diose may be formed in a solution initially comprising D-glucuronic acid or D-glucuronic acid glycoside. The xylo-pent-1,5-diose may be formed by electrochemical oxidative decarboxylation of the D-glucuronic acid or D-glucuronic acid glycoside in the solution in the presence of a graphite foil electrode with improved current efficiency and/or current density.

19 Claims, 3 Drawing Sheets

(56) References Cited

U.S. PATENT DOCUMENTS

| | | | | |
|---|---|---|---|---|
| 2003/0097029 | A1 | 5/2003 | Heikkila et al. | |
| 2005/0272961 | A1 * | 12/2005 | BeMiller et al. | 568/863 |

OTHER PUBLICATIONS

Stapley, "Oxidative Decarboxylation of Glucuronosides and the Synthesis of Xylitol", Thesis (Aug. 2004), pp. 1-103.*

Lee et al., "A Graphite Foil Electrode Covered with Electrochemically Exfoliated Graphene Nanosheets", Electrochemistry Communications (no month, 2010), vol. 12, pp. 1419-1422.*

New Riverside University Dictionary, © (no month) 1984, 1988 (4 pages total).*

PCT Search Report and Written Opinion mailed Mar. 31, 2010 for corresponding PCT Application No. PCT/US2009/051897.

* cited by examiner

10 D-glucuronic acid (pyranose form)

20 D-glucuronic acid glycoside (pyranose form)

50 xylo-pent-1,5-diose

60 methyl alpha-D-glucuronopyranoside

50 xylo-pent-1,5-diose

METHODS FOR THE ELECTROLYTIC PRODUCTION OF XYLO-PENT-1,5-DIOSE

This application is a National Stage of International Application PCT/US2009/051897 filed Jul. 28, 2009, which claims the benefit of the filing date under 35 U.S.C. §119(e) of Provisional U.S. Patent Application Ser. No. 61/087,350, filed Aug. 8, 2008. The entirety of both applications is hereby incorporated by reference.

TECHNICAL FIELD

The present disclosure relates to improved electrochemical methods of producing xylo-pent-1,5-diose, preferably employing a graphite foil electrode

BACKGROUND

Xylitol is a commercially available polyol with unique health benefits. It is traditionally produced from the reduction of xylose isolated from xylose-rich biopolymers, as in U.S. Pat. Nos. 2,989,569, 3,558,725, and 4,008,285. As these process are resource and cost intensive, researchers have sought for novel methods for the production of xylitol. These include various synthetic chemical processes, the use of microorganisms, and processes such as fermentation. As the structure of xylitol is similar to that of glucose, one can produce xylitol-precursors by decarboxylating carbon-6 of glucose. D-Glucuronic acid (glucose with carbon-6 oxidized to a carboxylic acid) and its derivatives are ideal candidates for such a decarboxylation. Heikkila et al., in published US patent application US2003/0097029, describes the production of xylitol from sources including glucuronic acid. However, in every case where D-glucuronic acid is used as the starting material, it is first hydrogenated to yield L-gulonic acid, which is then decarboxylated by either hypochlorous acid (Example 5) or by the Ruff Degradation (Example 6), both standard carbohydrate decarboxylation methods, to yield L-xylose. Despite these developments, there remains a need to produce xylitol in a manner that is low cost and yields high-purity product.

Stapley et al., in published US patent application US2005/0272961, describe a novel electrolytic oxidative decarboxylation technique using the otherwise decarboxylation-resistant D-glucuronic acid or D-glucuronic acid glycoside as a substrate to yield xylo-pent-1,5-diose, which is easily hydrogenated to xylitol. However, to realize the commercial viability of the electrolytic decarboxylation of D-glucuronic acid or D-glucuronic acid glycoside, there remains a need for an anode which converts D-glucuronic acid or D-glucuronic acid glycoside to yield xylo-pent-1,5-diose with a desirably high current efficiency and high reaction selectivity. Therefore, there remains a need for improved methods and electrodes for performing the electrolytic oxidative decarboxylation of glucuronoside substrates with improved current efficiency and/or reaction selectivity.

SUMMARY

The present disclosure provides methods and electrolytic cells for the electrolytic oxidative decarboxylation of glucuronosides to yield xylo-pent-1,5-diose. In particular, preferred methods and electrolytic cells described herein use a graphite foil electrode to provide improved current efficiency and/or reaction selectivity for the electrolytic oxidative decarboxylation of glucuronosides to yield xylo-pent-1,5-diose. The improved current efficiency and reaction selectivity achieved in this manner provide substantial improvements for performing the electrolytic oxidative decarboxylation of glucuronoside substrates in a more cost-effective manner.

Preferably, the methods of producing xylo-pent-1,5-diose include the electrolytic oxidative decarboxylation of D-glucuronic acid or D-glucuronic acid glycoside. The electrolytic oxidative decarboxylation step is preferably performed in an electrolytic cell using a graphite foil anode. The D-glucuronic acid or D-glucuronic acid glycoside may be methyl alpha-D-glucuronopyranoside. The D-glucuronic acid or D-glucuronic acid glycoside is preferably maintained in a solvent, where 35%-80% (more preferably about 50%) of the D-glucuronic acid or D-glucuronic acid glycoside is neutralized during the electrolytic decarboxylation. For example, the solvent is preferably water, although other solvents can also be used, the starting D-glucuronic acid or D-glucuronic acid glycoside may be 50% neutralized methyl alpha-D-glucuronopyranoside.

DETAILED DESCRIPTION

Figure 1:
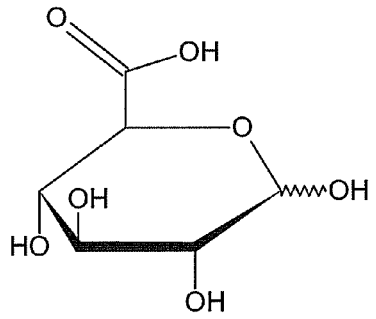
FIG. 1 is a reaction scheme showing the reaction step.
Figure 1:
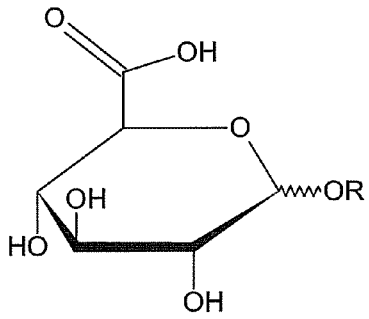
Figure 1:
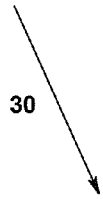
Figure 1:
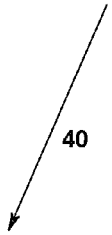
Figure 1:
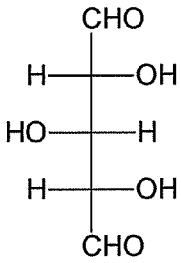

The methods for the production of xylo-pent-1,5-diose disclosed in present disclosure preferably include the step of the electrolytic oxidative decarboxylation of a D-glucuronic acid glycoside.

DEFINITIONS

As used herein, the term "D-glucuronic acid glycoside" refers to any D-glucuronic acid compound with a where the D-glucuronic acid is in a glycosidic linkage.

Recitation of "xylo-pent-1,5-diose" herein refers to carbohydrate with chemical formula C5H805. A Fischer Projection of the xylo-pent-1,5-diose structure (1) is provided below.

(1)

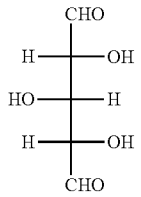

The term "decarboxylation" as used herein refers to the removal of a carboxyl group (—COOH) by a chemical reaction or physical process. Typical products of a decarboxylation reaction may include carbon dioxide (CO2) or formic acid.

The term "electrochemical" refers to chemical reactions that can take place at the interface of an electrical conductor (an electrode) and an ionic conductor (the electrolyte). Electrochemical reactions can create a voltage potential between two conducting materials (or two portions of a single conducting material), or can be caused by application of external voltage. In general, electrochemistry deals with situations where an oxidation and a reduction reaction is separated in space. The term "electrolytic" as used herein refers to an electrochemical oxidation or reduction reaction that results in the breaking of one or more chemical bonds. Electrolytic reactions as used herein preferably describe reactions occurring as a product of interaction with a cathode or anode.

Any concentration ranges, percentage range, or ratio range recited herein are to be understood to include concentrations, percentages or ratios of any integer within that range and fractions thereof, such as one tenth and one hundredth of an integer, unless otherwise indicated. Also, any number range recited herein relating to any physical feature, such as polymer subunits, size or thickness, are to be understood to include any integer within the recited range, unless otherwise indicated. It should be understood that the terms "a" and "an" as used above and elsewhere herein refer to "one or more" of the enumerated components. For example, "a" polymer refers to one polymer or a mixture comprising two or more polymers. As used herein, the term "about" refers to differences that are insubstantial for the relevant purpose or function.

As used herein, "derivative" refers to a chemically or biologically modified version of a chemical compound that is structurally similar to a parent compound and (actually or theoretically) derivable from that parent compound. A derivative may or may not have different chemical or physical properties of the parent compound. For example, the derivative may be more hydrophilic or it may have altered reactivity as compared to the parent compound. Derivatization (i.e., modification) may involve substitution of one or more moieties within the molecule (e.g., a change in functional group) that do not substantially alter the function of the molecule for a desired purpose. The term "derivative" is also used to describe all solvates, for example hydrates or adducts (e.g., adducts with alcohols), active metabolites, and salts of the parent compound. The type of salt that may be prepared depends on the nature of the moieties within the compound. For example, acidic groups, for example carboxylic acid groups, can form, for example, alkali metal salts or alkaline earth metal salts (e.g., sodium salts, potassium salts, magnesium salts and calcium salts, and also salts quaternary ammonium ions and acid addition salts with ammonia and physiologically tolerable organic amines such as, for example, triethylamine, ethanolamine or tris-(2-hydroxyethyl)amine). Basic groups can form acid addition salts, for example with inorganic acids such as hydrochloric acid, sulfuric acid or phosphoric acid, or with organic carboxylic acids and sulfonic acids such as acetic acid, citric acid, benzoic acid, maleic acid, fumaric acid, tartaric acid, methanesulfonic acid or p-toluenesulfonic acid. Compounds which simultaneously contain a basic group and an acidic group, for example a carboxyl group in addition to basic nitrogen atoms, can be present as zwitterions. Salts can be obtained by customary methods known to those skilled in the art, for example by combining a compound with an inorganic or organic acid or base in a solvent or diluent, or from other salts by cation exchange or anion exchange.

As used herein, "analogue" refers to a chemical compound that is structurally similar to another but differs slightly in composition (as in the replacement of one atom by an atom of a different element or in the presence of a particular functional group), but may or may not be derivable from the parent compound. A "derivative" differs from an "analogue" in that a parent compound may be the starting material to generate a "derivative," whereas the parent compound may not necessarily be used as the starting material to generate an "analogue."

Electrochemical Decarboxylation

The step of oxidative decarboxylation of a reactant substrate is preferably performed by an electrochemical oxidative decarboxylation of the reactant substrate. FIG. 1 shows a schematic diagram describing various methods related to the production of xylo-pent-1,5-diose. Preferably, the methods include the step of electrolytic decarboxylation of a suitable reactant to produce xylo-pent-1,5-diose. The reactant can be provided as a solution of the reactant placed in contact with an electrode to effect a decarboxylation of the reactant so as to produce xylo-pent-1,5-diose.

Any suitable D-glucuronic acid or D-glucuronic acid glycoside capable of producing xylo-pent-1,5-diose as a product of an electrolytic decarboxylation step can be used as a reactant. The reactant is preferably methyl alpha-D-glucuronpyranoside. Suitable reactants include derivatives and analogs of the carboxylic acid reactant can include reactants with chemical structure variations that insubstantially vary the reactivity of the molecule from undergoing an electrolytic decarboxylation process to produce xylo-pent-1,5-diose or an intermediate that can be converted to xylo-pent-1,5-diose.

FIG. 1 shows an exemplary reaction scheme where D-glucuronic acid is a first reactant 10 that undergoes a decarboxylation reaction 30 to produce a xylo-pent-1,5-diose product 50. Also shown is an alternative aspect of the first embodiment, wherein a D-glucuronic acid glycoside is a second reactant 20 that undergoes an oxidative decarboxylation reaction 40 to produce the xylo-pent-1,5-diose product 50. Preferably, the decarboxylation reaction 30, 40 is performed electrochemically. In one aspect, electrolytic decarboxylation of a reactant in a solution provides a desired product or intermediate that can be subsequently converted to the desired product.

Figure 2:
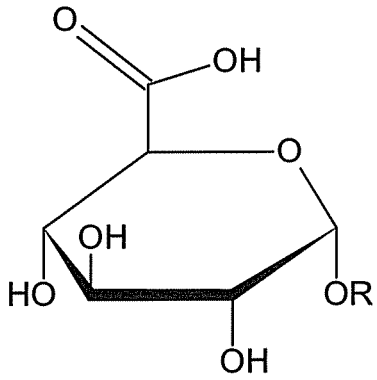
FIG. 2 is a reaction scheme showing examples of certain preferred reaction steps.
Figure 2:
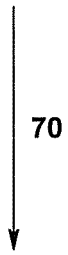
Figure 2:
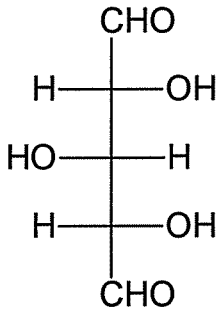

FIG. 2 shows the preferred reaction steps. Preferably, the reactant is methyl alpha-D-glucuronopyranoside 60. The reactant can be provided in a suitable solution comprising at least the reactant and a solvent. The reactant can be dissolved in the solvent by any suitable method, including stirring and/or heating where appropriate. The solvent can be any aqueous solvent in which the reactant can dissolve to a desired extent. Preferably, the solvent is water or any water-miscible solvent-water combination. For example, solvents can comprise one or more of the following: water, methanol, ethanol, propanol, dioxane and acetonitrile. The solution is preferably an acidic solution comprising a D-glucuronic acid or D-glucuronic acid, or a combination thereof.

Preferably, at least about 10% of the D-glucuronic acid or D-glucuronic acid glycoside is neutralized or exists as a corresponding salt thereof. For example, the acid reactant solution can be provided with about 10, 20, 30, 40, 50, 60, 70, 80, 90, or 100% of one or more reactant acids neutralized. Preferably, 10%-100% of at least one D-glucuronic acid or D-glucuronic acid glycoside reactant is neutralized. More preferably, about 35%-80% of a D-glucuronic acid or D-glucuronic acid glycoside reactant present is neutralized. Most preferably, about 50% of the D-glucuronic acid or D-glucuronic acid glycoside reactant present in a reactant acid solution is neutralized.

In one aspect, the reactant acid solution is provided at about 10-100% neutralization, more preferably about 35-80% neutralization and most preferably about 50% neutralization of the reactant acid. The pH can be permitted to increase as the electrolytic reaction proceeds. Optionally, the pH could be provided and/or maintained within a desirable range throughout the reaction, for example by conducting the reaction in an ion exchange resin. The pH could also be controlled by using a divided electrolytic cell with a cation exchange membrane. The reactant acid solution can have any suitable pH to provide a desired concentration of dissociated reactant. For a reactant acid solution comprising an ribonic acid, the pH is preferably between about 3.0 and 4.0 prior to beginning the decarboxylation reaction. For a reactant solution comprising a D-glucuronic acid or D-glucuronic acid glycoside reactant, the pH is preferably between 3.0 and 4.0 prior to beginning the decarboxylation reaction.

Optionally, the residual reactant can be recycled by separating the starting material from products, for example by use of an anionic exchange resin. A partially decarboxylated solution of acid can contain both the starting acid (e.g., D-glucuronic acid or D-glucuronic acid glycoside) and the aldehydic product (e.g., xylo-pent-1,5-diose). The negatively charged D-glucuronic acid or D-glucuronic acid glycoside can adhere to positively charged anionic exchange media. A partially reacted solution can be passed over a bed or column of ion exchange resin beads to replace the D-glucuronate or D-glucuronate glycoside with hydroxyl moieties ($OH^-$). The solution can then be passed over cationic resin to strip any cations and neutralize the OH—. The resulting solution can comprise higher levels of the nonionic species (e.g., xylo-pent-1,5-diose). Once the anionic exchange resin is saturated with D-glucuronate or D-glucuronate glycoside, it can be removed by treating the resin with OH—. While the ion exchange resin recycling process has been illustrated with respect to hydroxyl (OH—) functional groups, other suitable groups may also be employed.

Electrolytic Apparatus

The electrochemical decarboxylation of a suitable acid reactant can be performed using any suitable structure. Preferably, the electrochemical decarboxylation is performed by contacting an acid reactant solution comprising a D-glucuronic acid or D-glucuronic acid glycoside with an anode, where the reactant can be oxidative decarboxylated. Contact between the starting material and the anode can elicit the decarboxylation, which can result in liberation of carbon dioxide and formation of a product such as xylo-pent-1,5-diose. The product of the decarboxylation is preferably an aldehyde such as xylo-pent-1,5-diose, or an intermediate such as an analog or derivative of xylo-pent-1,5-diose that can be converted to xylo-pent-1,5-diose.

Figure 3:
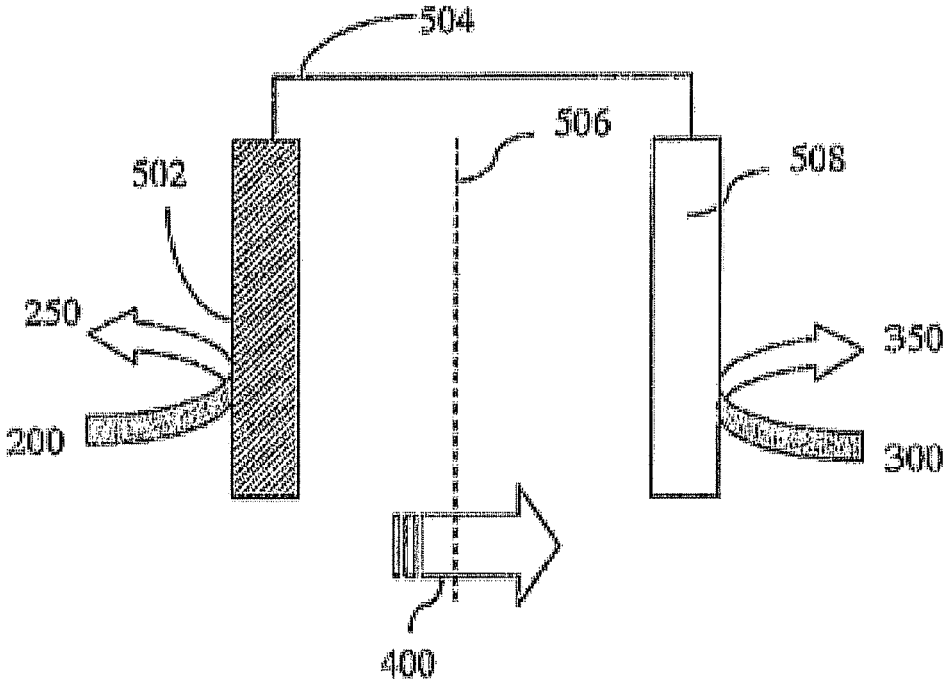
FIG. 3 is a schematic of an electrolytic oxidative decarboxylation step.

Preferably, the electrochemical decarboxylation of the reactant is conducted in an apparatus having any configuration comprising an anode in electrically conducting communication with a cathode. FIG. 3 shows a schematic of an electrochemical apparatus for decarboxylation of a reactant acid to form a desired product, such as erythrose. The apparatus comprises an anode 502 connected through a means for electrical conduction 504 to a cathode 508.

The anode 502 preferably comprises a graphite foil reactive surface where oxidation of the reactant acid can occur. The reactant acid 200 can be a D-glucuronic acid or D-glucuronic acid glycoside as described above that is oxidized at or near the reactant surface of the anode 502 to form a product 250 such as xylo-pent-1,5-diose.

Preferably, the electrochemical cell further comprises a cathode 508, where a reduction can occur within the electrochemical cell. The cathode 508 can be formed from any suitable material having a desired level of electrical conductivity, such as stainless steel. In one aspect, the decarboxylation reaction at the anode can be:

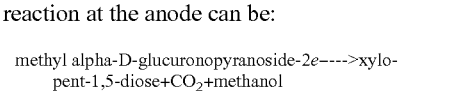

methyl alpha-D-glucuronopyranoside-2$e$---->xylo-pent-1,5-diose+$CO_2$+methanol

The counter electrode reaction can be:

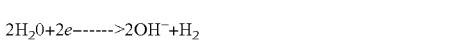

$2H_20+2e$------>$2OH^-+H_2$

Typically, some current can be lost to the production of $O_2$ gas at the anode.

The electrolytic cell can have any suitable configuration. An apparatus for the decarboxylation of a reactant substrate preferably comprises an electrochemical cell. The electrochemical cell can be configured to maintain the acid solution comprising the reactants in contact with an anode (undivided configuration). Optionally, a cathode can be maintained in contact with the acid solution in the same cell as the anode, or in a separate, second cell (a divided configuration). In the divided configuration, a means for ion transport preferably connects the first and second cell, such as a semi-permeable membrane. Preferably, the membrane is permeable to protons.

The methods for producing xylo-pent-1,5-diose using an electrolytic apparatus can yield about 20, 30, 40, 40, 50, 60, 70, 80, 85, 90, 95 or up to 100% of the theoretical yield, preferably at least about 35%, more preferably at least about 60%, even more preferably at least about 80%, or most preferably at least about 95% or more of theoretical yield.

EXAMPLES

The following examples are to be considered illustrative of various aspects of the invention and should not be construed to limit the scope of the invention, which are defined by the appended claims.

TABLE 1

| Expt. # | Anode | Current Density mA/cm$^2$ | Product Current Efficiency, % | Selectivity (%) |
|---|---|---|---|---|
| 641-85 | Polyimide/ Graphite | 100 | 12.1 | 69.1 |
| 641-25 | SG-202 | 100 | 19.9 | 52.0 |
| 641-69 | PTFE/ Graphite | 100 | 18.1 | 64.3 |
| 641-93 | GFD Felt | 100 | 31.3 | 58.9 |
| 641-67 | Carbone 2191 | 100 | 33.7 | 88.4 |
| 646-11 | Asbury Flake 3763 | 100 | 41.3 | 71.6 |
| 641-89 | Pioneer Foil | 100 | 49.1 | 89.1 |
| 641-57 | Grafoil GTA | 100 | 56.0 | 99.8 |
| 641-47 | Sigraflex Foil | 40 | 57.4 | 96.9 |

With the exception of experiment 646-11, the experiments detailed in this report were performed in a glass cell using a flag anodes. The glass cell consisted of a large test tube, a 5 cm$^2$ stainless steel cathode flag welded to a titanium rod, and a 5 cm$^2$ anode flag attached to a graphite rod current collector. In all experiments approximately 25 ml of a 1 M methyl alpha-D-glucuronoside solution (207.16 grams per liter), which was 50% neutralized with sodium hydroxide (20.00 grams per liter), was placed in the electrochemical cell. After 2 faradays per mole of charge at a constant current was passed through the cell 0.2-mL aliquot of the reaction mixture was stirred for 15-30 min with 0.1 mL of a solution containing 25-30 mg/mL sodium borohydride. The mixture was then acidified to pH≤5 with 1 drop of 1.5 M sulfuric acid, stirred for an additional 15 min, diluted as applicable and analyzed by HPLC equipped with a 300×7.8 mm Rezex ROA (Phenomenex Inc.), matching 50×7.8 mm guard column and refractive index detector to determine the loss of starting material, which is unaffected by the borohydride and the formation of xylo-pent-1,5-diose, as measured by its borohydride conversion product, xylitol.

In order to determine the optimal anode material for the production of xylo-pent-1,5-diose, many carbonaceous materials were tested:

Experiment 641-85 was performed with a graphite-polyimide composite anode flag formed from carbon fiber (80%) and polyimide (thermosetting variety) resin.

Experiment 641-125 was performed with an Electrolytica SG-202 anode flag. SG-202 is a dense non-porous graphite.

Experiment 641-69 was performed with a PTFE-Graphite composite (a ¼" plate of graphite impregnated with PTFE).

Experiment 641-93 was performed with a 4 mm thick (PAN based) Sigratherm GFD felt anode flag.

Experiment 641-67 was performed with a Carbone of America 2191 low resistance graphite anode flag.

Experiment 641-89 was performed with a Pioneer Industries ⅛" graphite foil anode flag.

Experiment 641-57 was performed with a GrafTek Grafoil GTA graphite foil anode flag.

Experiment 641-47 was performed with a Sigraflex 1.25 gram per cubic centimeter graphite foil anode flag.

Experiment 646-11 was executed in a micro flow cell in which the solution was passed through (as opposed to across) both electrodes. The anode compartment featured a perforated graphite plate current carrier and the Asbury Flake 3763 graphite flake bed with a total volume of 2.7 $cm^3$. The cathode compartment was separated by a polypropylene mesh and featured a slotted plate cathode. Approximately 100 ml of a 1 M methyl alpha-D-glucuronoside solution, which was 50% neutralized with sodium hydroxide, was placed in the cell with a flow rate of 350-400 ml per minute. After 2 faradays per mole of charge was passed through the cell at a constant current the reaction solution was analyzed as the other experiments.

We claim:

1. A method of producing xylo-pent-1,5-diose in a solution initially comprising D-glucuronic acid or D-glucuronic acid glycoside, the solution having between about 35% and 80% of the D-glucuronic acid or D-glucuronic acid glycoside neutralized, the method comprising the step of electrolytically decarboxylating the D-glucuronic acid or D-glucuronic acid glycoside in the solution in the presence of a graphite foil anode to produce xylo-pent-1,5-diose.

2. The method of claim 1, where the xylo-pent-1,5-diose is produced with a product current efficiency of at least about 49%.

3. The method of claim 2, where the xylo-pent-1,5-diose is produced with a selectivity of at least about 90% at a current density of 100 $mA/cm^2$.

4. The method of claim 3, where the D-glucuronic acid or D-glucuronic acid glycoside is methyl alpha-D-glucuronopyranoside.

5. The method of claim 4, where the solution has about 50% of the D-glucuronic acid or D-glucuronic acid glycoside neutralized.

6. The method of claim 5, wherein the electrolytic decarboxylation of the D-glucuronic acid or D-glucuronic acid glycoside in the solution is performed by contacting the D-glucuronic acid or D-glucuronic acid glycoside in the solution with the graphite foil anode.

7. The method of claim 1, where the xylo-pent-1,5-diose is produced with a selectivity of at least about 90% at a current density of 100 $mA/cm^2$.

8. The method of claim 1, where the D-glucuronic acid or D-glucuronic acid glycoside is methyl alpha-D-glucuronopyranoside.

9. The method of claim 1, where the solution has about 50% of the D-glucuronic acid or D-glucuronic acid glycoside neutralized.

10. The method of claim 1, wherein the solution comprises the D-glucuronic acid or D-glucuronic acid glycoside and a solvent selected from the group consisting of: water and a water-miscible solvent.

11. The method of claim 10, wherein the water-miscible solvent is selected from the group consisting of: water, methanol, ethanol, propanol, dioxane and acetonitrile.

12. The method of claim 1, wherein the electrolytic decarboxylation of the D-glucuronic acid or D-glucuronic acid glycoside in the solution is performed by contacting the D-glucuronic acid or D-glucuronic acid glycoside in the solution with the graphite foil anode.

13. The method of claim 1, where the xylo-pent-1,5-diose is produced with a product current efficiency of at least about 49%, and a selectivity of at least about 90% at a current density of 100 $mA/cm^2$; and where the electrolytic decarboxylation of the D-glucuronic acid or D-glucuronic acid glycoside in the solution is performed by contacting the D-glucuronic acid or D-glucuronic acid glycoside in the solution with the anode.

14. The method of claim 1, wherein the electrolytic decarboxylation of the D-glucuronic acid or D-glucuronic acid glycoside in the solution is further characterized by contacting the acid in the solution with a portion of an electrolytic cell having a divided, undivided, flow-through or batch cell.

15. A method of producing xylo-pent-1,5-diose, comprising:

providing an electrolytic cell with a graphite foil anode;

contacting the graphite foil anode with a solution comprising one or more of D-glucuronic acid and D-glucuronic acid glycoside, the solution having between about 35% and 80% of the D-glucuronic acid or D-glucuronic acid glycoside neutralized; and applying an electric current to the cell thereby decarboxylating the D-glucuronic acid or D-glucuronic acid glycoside in the solution to produce xylo-pent-1,5-diose.

16. The method of claim 15, where the xylo-pent-1,5-diose is produced with a product current efficiency of at least about 49%.

17. The method of claim 15, where the xylo-pent-1,5-diose is produced with a selectivity of at least about 90% at a current density of at least 100 $mA/cm^2$.

18. The method of claim 15, where the D-glucuronic acid or D-glucuronic acid glycoside is methyl alpha-D-glucuronopyranoside.

19. The method of claim 15, where the solution has about 50% of the D-glucuronic acid or D-glucuronic acid glycoside neutralized.

* * * * *